US010525482B2

(12) United States Patent
Vareika et al.

(10) Patent No.: US 10,525,482 B2
(45) Date of Patent: Jan. 7, 2020

(54) MAGNETIC DRUM INLET SLIDE AND SCRAPER BLADE

(71) Applicant: Evoqua Water Technologies LLC, Warrendale, PA (US)

(72) Inventors: Matthew J. Vareika, Lakeville, MA (US); Joseph P. Gwarjanski, Minot, ME (US); Frank W. Federico, Winchester, MA (US); Simone Klyamkin, Brighton, MA (US)

(73) Assignee: Evoqua Water Technologies LLC, Pittsburgh, PA (US)

( * ) Notice: Subject to any disclaimer, the term of this patent is extended or adjusted under 35 U.S.C. 154(b) by 0 days.

(21) Appl. No.: 14/647,247

(22) PCT Filed: Mar. 11, 2013

(86) PCT No.: PCT/US2013/030145
§ 371 (c)(1),
(2) Date: May 26, 2015

(87) PCT Pub. No.: WO2014/088620
PCT Pub. Date: Jun. 12, 2014

(65) Prior Publication Data

US 2015/0298138 A1 Oct. 22, 2015

Related U.S. Application Data

(60) Provisional application No. 61/733,111, filed on Dec. 4, 2012, provisional application No. 61/734,095, filed on Dec. 6, 2012.

(51) Int. Cl.
*B03C 1/14* (2006.01)
*B03C 1/033* (2006.01)

(52) U.S. Cl.
CPC ..... *B03C 1/145* (2013.01); *B03C 1/0332* (2013.01); *B03C 1/14* (2013.01); *B03C 2201/18* (2013.01)

(58) Field of Classification Search
CPC ..... B03C 1/145; B03C 1/10; B03C 1/0332; B03C 2201/18; B03C 1/14
See application file for complete search history.

(56) References Cited

U.S. PATENT DOCUMENTS 2,565,089 A 8/1951 Prince
2,758,715 A * 8/1956 Fowler ..... B03C 1/12 209/219
2,912,107 A 11/1959 Palm
2,952,361 A * 9/1960 Newton ..... B03C 1/14 209/223.1
4,293,410 A 10/1981 Streuli et al.
(Continued)

FOREIGN PATENT DOCUMENTS

CN 200970548 Y 11/2007
CN 202238297 U 5/2012
(Continued)

OTHER PUBLICATIONS

Definition of "proximate" by Merriam-Webster Dictionary No Date.*

*Primary Examiner* — Liam Royce

(57) ABSTRACT

A magnetic separator is provided with one or more components that may enhance separation of magnetic and non-magnetic materials. The one or more components may comprise at least one of a slide and a scraper blade.

10 Claims, 6 Drawing Sheets

(56) References Cited

U.S. PATENT DOCUMENTS

| | | | | |
|---|---|---|---|---|
| 6,478,955 | B1 | 11/2002 | Saho et al. | |
| 8,056,728 | B2 | 11/2011 | Riise et al. | |
| 2008/0164183 | A1 | 7/2008 | Marston et al. | |
| 2013/0333151 | A1 * | 12/2013 | Nishizawa | B03C 1/247 15/256.53 |

FOREIGN PATENT DOCUMENTS

| | | | | |
|---|---|---|---|---|
| DE | 973611 | C | 4/1960 | |
| DE | 3513800 | A1 | 10/1986 | |
| DE | 4207335 | A1 | 9/1993 | |
| GB | 910476 | A | 11/1962 | |
| WO | WO-2012086475 | A1 * | 6/2012 | B03C 1/247 |

* cited by examiner

MAGNETIC DRUM INLET SLIDE AND SCRAPER BLADE

CROSS-REFERENCE TO RELATED APPLICATIONS

This application is a U.S. national stage application and claims the benefit under 35U.S.C. § 371 of PCT/US2013/030145, titled MAGNETIC DRUM INLET SLIDE AND SCRAPER BLADE, filed Mar. 11, 2013, which claims priority to United States Provisional Applications Serial No. 61/734,095, filed Dec. 6, 2012, and Serial No. 61/733,111, filed Dec. 4, 2012, which contents are hereby incorporated herein by reference in their entireties for all purposes.

FIELD OF TECHNOLOGY

One or more aspects of the disclosure relate generally to separations, and more particularly to systems and methods for separating a magnetic material from a nonmagnetic material.

SUMMARY

One or more aspects of the disclosure provide for a magnetic separator. The magnetic separator comprises a rotatable drum comprising an inner surface and an outer surface, and a magnet positioned in the rotatable drum. The magnetic separator comprises an inlet connectable to a source of a slurry comprising a magnetic material and a nonmagnetic material, an outer wall, and a channel defined by a portion of the outer surface of the rotatable drum and the outer wall. The magnetic separator comprises a slide positioned in the channel, a magnetic material outlet, and a nonmagnetic material outlet.

One or more additional aspects of the disclosure provides for a method of retrofitting a magnetic separator comprising a rotatable drum comprising an inner surface and an outer surface, a magnet positioned in the rotatable drum, an inlet connectable to a source of a slurry comprising a magnetic material and a nonmagnetic material, an outer wall, and a channel defined by a portion of the outer surface of the rotatable drum and the outer wall. The method comprises securing a slide to the outer wall, the slide positioned in the channel and in proximity to the inlet.

One or more additional aspects of the disclosure provides for a magnetic separator comprising an outer wall and a rotatable drum comprising an inner surface and an outer surface. The magnetic separator comprises a magnet positioned in the rotatable drum and an inlet connectable to a source of a slurry comprising a magnetic material and a nonmagnetic material. The magnetic separator comprises a scraper blade secured to the outer wall, a magnetic material outlet and a nonmagnetic material outlet.

DESCRIPTION OF THE DRAWINGS

The accompanying drawings are not intended to be drawn to scale. For purposes of clarity, not every component may be labeled in the drawings, nor is every component of each embodiment of the disclosure shown where illustration is not necessary to allow those of ordinary skill in the art to understand the disclosure.

DETAILED DESCRIPTION

Figure 1:
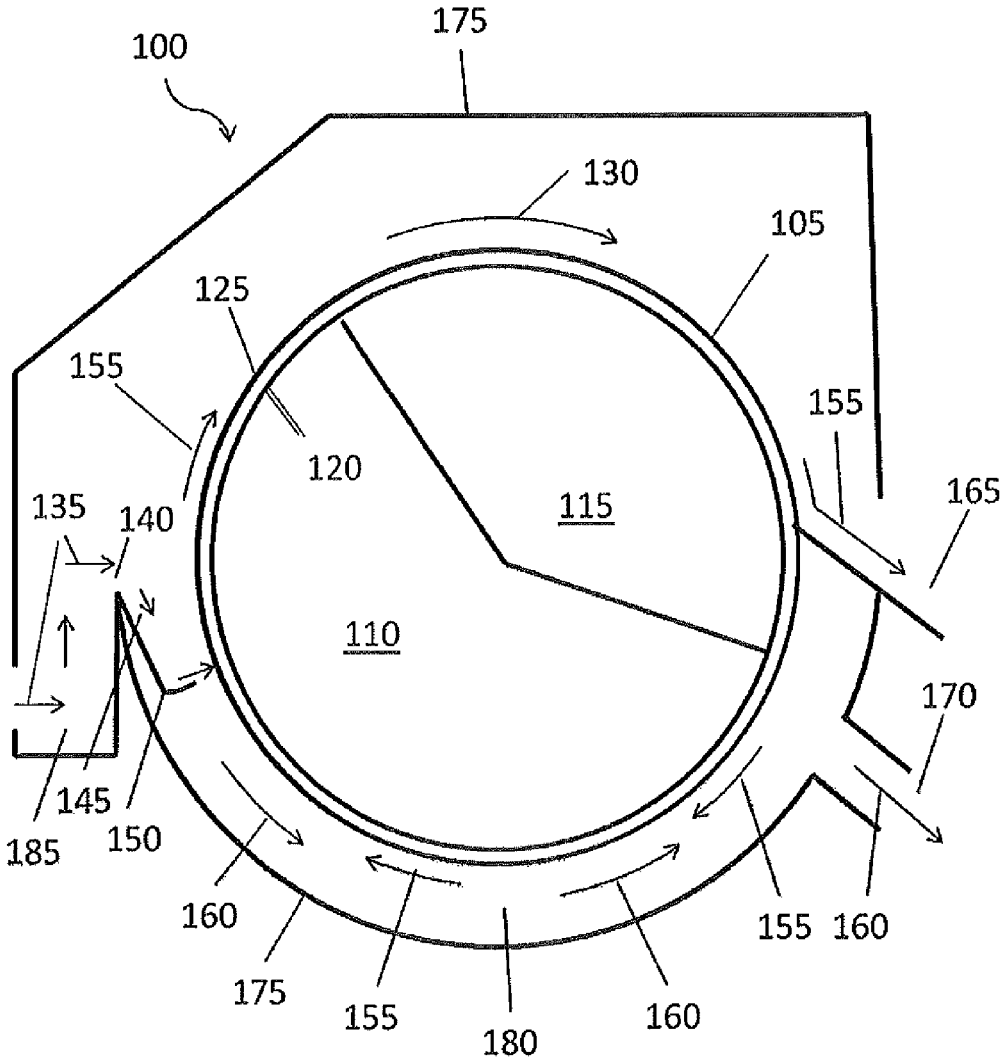
FIG. 1 presents a cross-sectional side view of a magnetic drum separator with slide in accordance with one or more embodiments of the disclosure.

Magnetic drums may be used to separate a magnetic material from a nonmagnetic material in a feed, such as a slurry. These separation processes may carry over an excessive amount of nonmagnetic material with the separated magnetic material, which may impact the separation, and ultimately, the efficiency of the operation of the drum.

Existing magnetic drums use a simple design to distribute flow to the bottom portion of the drum, where portions of the slurry first contact the drum surface.

Existing magnetic recovery drums do not effectively separate bio-solids from magnetic material without the use of relatively costly shear mills Shear mills are commonly used upstream of recovery drums to enhance the separation of magnetic material from nonmagnetic material on these drums. Mechanical shearing mills, while effective, are also expensive in terms of capital and operating costs. For instance a shearing mill may require an electric motor with a power rating of 30 HP.

Magnetic separators may be used to separate magnetic material from nonmagnetic material. Magnetic separators may be implemented in a variety of applications. For example, magnetic separators may be used in mining, construction, recycling and water or wastewater treatment applications. In water and wastewater treatment applications, a magnetic separator, such as a magnetic drum may be used, for example, to separate a magnetic material from a nonmagnetic material.

By magnetic material, it is meant one or more components, or a plurality of components that may be pulled towards or attracted to a magnet. A magnet is a material or object that produces a magnetic field. The magnet may be an object made from a material that is magnetized and creates its own persistent magnetic field. The magnetic material may be a ferromagnetic material that may comprise iron. Other ferromagnetic materials may include iron, nickel, cobalt, alloys of rare earth metals, and some naturally occurring minerals.

The magnetic material may be capable of being attracted to the magnet. The magnetic material may also be capable of being attracted to the magnet and be capable of being attached, connected, or affixed to the magnet, or may also be capable of being in the immediate proximity of the magnet. For example, if a magnet is positioned within a part of the magnetic drum, the part having an inner portion in which the magnet is positioned and an outer portion having an outer surface, the magnetic material may be capable of being attracted to the magnet and may attach or affix itself on the outer surface of the part, in immediate proximity of the magnet.

The nonmagnetic material is typically not capable of being attracted to the magnet. The magnetic material is not capable of being attached, connected, or affixed to the magnet due to the magnetic force of the magnet.

The magnetic separator may be used in a wastewater treatment system that uses magnetic ballast. The magnetic ballast may be mixed with wastewater to provide weighted flocculants that then may be separated by sedimentation or clarification. The magnetic ballast may be used in a magnetic ballasted flocculation wastewater treatment system.

The magnetic separator may separate a magnetic material from a nonmagnetic material. In certain instances, the magnetic separator may separate a magnetic ballast, or magnetic weighting agent, from a wastewater stream comprising biological floc.

The magnetic ballast may comprise an inert material. The magnetic ballast may comprise a ferromagnetic material. The magnetic ballast may comprise iron-containing material. In certain embodiments, the magnetic ballast may comprise an iron oxide material. For example, the magnetic ballast may comprise magnetite ($Fe_3O_4$). The magnetic ballast may have a particle size that allows it to bind with biological flocs to provide enhanced settling or clarification, and allow it to be attracted to a magnet so that it may be separated from the biological flocs. The particle size of the magnetic ballast may be less than about 100 micrometers (μm). The particle size of the magnetic ballast may be less than about 40 μm. The particle size of the magnetic ballast may be less than about 20 μm. The weighting agent may include magnetite.

The magnetic separator of the present disclosure may provide an enhanced system and method for separating a magnetic material from a nonmagnetic material. The magnetic separator may provide an enhanced system and method for separating a magnetic weighting agent from a slurry. The slurry may comprise the magnetic weighting agent and a biological floc. In certain embodiments, the slurry may comprise magnetite and a biological floc.

In certain embodiments, the magnetic separator may comprise a magnetic drum. The magnetic drum may comprise a rotatable drum and a magnet positioned in the rotatable drum. The rotatable drum may comprise an inner surface and an outer surface. The magnetic separator may comprise an inlet connectable to a source of a slurry comprising a magnetic material and a nonmagnetic material. The separator may comprise a magnetic material outlet, and a nonmagnetic material outlet.

The magnet of the magnetic separator may be positioned in a predetermined portion of the inner surface of the rotatable drum. The predetermined portion may be selected to enhance the separation of the magnetic material from the nonmagnetic material. In certain embodiments, the magnet may be positioned in greater than half of the inner surface of the rotatable drum. The magnet may also be positioned at least partially in the upper half of the rotatable drum.

A component of the magnetic separator may assist in delivering the slurry to the rotatable drum having a magnet positioned in the rotatable drum. The component of the magnetic separator may assist in directing the slurry towards the outer surface of the rotatable drum. The component may assist in putting the fluid in contact with a magnetic area of the drum for a period of time that assists in enhancing the separation of the magnetic material from the nonmagnetic material. The component of the magnetic separator may increase the velocity of the slurry and may allow for rinsing of the magnetic material to provide for enhanced separation. The component may increase the exposure time of the slurry on the surface of the rotatable drum, leading to increased collection and separation efficiency of the magnetic separator.

The component of the magnetic separator may be a slide. The slide may be positioned in a channel that is defined by a portion of an outer surface of the rotatable drum and the outer wall of the magnetic separator. The slide may be any shape that may assist in directing the slurry against the outer surface of the rotatable drum, assist in putting the fluid in contact with a magnetic area of the drum for a period of time that assists in enhancing the separation of the magnetic material from the nonmagnetic material, may increase the velocity of the slurry and may allow for rinsing of the magnetic material to provide for enhanced separation. The slide may also be any shape that may increase the exposure time of the slurry on the surface of the rotatable drum, leading to increased collection and separation efficiency of the magnetic separator. For example, the slide may be v-shaped, u-shaped or parabolic shaped; or a modified v-shape or u-shape, or a parabolic shape.

In certain embodiments, a component of the magnetic separator may be provided that enhances separation of the magnetic material from the nonmagnetic material. The component may allow for magnetic material to maintain contact with the outer surface of the rotatable drum while assisting in removing nonmagnetic material from the magnetic material that is in contact with the rotatable drum.

The component may be a scraper blade. The scraper blade may be positioned in close proximity to the rotatable drum, but may not be in contact with the drum. In certain embodiments, the scraper blade may be in contact with the drum. The scraper blade may have any shape or size, configuration, and may be comprised of any material to create a connection or bridge between the surface of the drum and the scraper blade with the magnetic material. Magnetic material, for example, powdered magnetite, may form a bridge from the scraper blade to the surface of the drum, wherein the bridge may function as a barrier, preventing nonmagnetic material, for example, bio-solids and other debris, on the rotating surface of the drum from passing through, but allowing magnetic material to continue to pass through.

The scraper blade may be secured to a portion of the magnetic separator, such as an outer wall. The scraper blade may be secured to an outer wall that runs approximately parallel to the outer surface of the rotatable drum, or it may be secured to an outer wall that runs approximately perpendicular to the outer surface of the rotatable drum. The scraper blade may be positioned to extend along a surface of the rotatable drum to provide for further enhancement of the separation of the nonmagnetic material from the magnetic material. In certain embodiments, the scraper blade may be in contact at a given time with an entire width of the rotatable drum.

The scraper blade may be secured to a wall to allow movement of at least a portion of the scraper blade away from or towards the rotatable drum. In certain embodiments, the scraper blade may be secured such that an edge of the scraper blade closest to the outer surface of the rotatable drum may be adjusted. In other embodiments, the scraper blade may be secured such that scraper blade, along its entire width. The adjustment may be performed based on the thickness of material passing along the outer surface of the rotatable drum. The scraper blade may be secured to the separator by various attachments, such as a u-channel. The scraper blade may be secured and configured within the separator so that it may come in close proximity to at least one magnet in the rotatable drum. This configuration may be preferred in embodiments when it is desirable for the magnet to impart a magnetic field on the scraper blade and/or its surroundings to attract magnetic material between the scraper blade and the outer surface of the rotatable drum.

The scraper blade may be positioned anywhere along the surface of the rotatable drum. In certain embodiments, the scraper blade may be positioned in line with one or more magnets. In these embodiments, the one or more magnets may impart a magnetic field on at least a portion of the scraper blade.

The scraper blade may be a compliant material that may allow for differences in thickness of material passing along the outer surface of the rotatable drum. In other embodiments, the scraper blade may be a rigid material.

The scraper blade may comprise a material capable of attracting magnetic material to its surface while in the presence of a magnetic field, for example, where the scraper blade is positioned in proximity to a portion of the outer surface of the drum near the magnetic area of the drum. In certain embodiments, the scraper blade may comprise a magnetic material. The scraper blade may comprise, for example, a ferric material. The scraper blade may comprise, for example, steel. The scraper blade may comprise, for example, carbon steel. In certain embodiments, magnetic material, for example, powdered magnetite, may form a bridge from the scraper blade to the surface of the drum, wherein the bridge may function as a barrier, preventing nonmagnetic material,for example, bio-solids or other debris, on the rotating surface of the drum from passing through, but allowing magnetic material to continue to pass through. These embodiments may have the advantage of reducing wear on the scraper blade.

In certain embodiments, a magnetic separator is provided comprising an outer wall and a rotatable drum comprising an inner surface and an outer surface. A magnet may be positioned in the rotatable drum. The magnetic separator may comprise an inlet connectable to a source of a slurry comprising a magnetic material and a nonmagnetic material. The separator may comprise a scraper blade secured to the outer wall and positioned to provide an aperture defined by an outer surface of the rotatable drum and the scraper blade. The magnetic separator may comprise a magnetic material outlet and a nonmagnetic material outlet.

The aperture may be sized to allow the magnetic material through the aperture, but prevent or reduce the amount of nonmagnetic material through the aperture. The aperture may be less than about 10 mm. In certain embodiments, the aperture may be in a range of about 0.0625 inches to about 0.375 inches (about 1.6 mm to about 9.53 mm).

In certain embodiments, the magnetic material outlet may be in fluid communication with the inlet over the top of the rotatable drum. The nonmagnetic material outlet may be in fluid communication with the inlet under a bottom portion of the drum.

In the magnetic separator system of the disclosure, a mixture of magnetic material, such as magnetite, and biological floc may be fed in the form of a slurry or otherwise to a wet drum magnetic separator where the magnetic particles are extracted from the slurry and recovered. A magnetic separator comprises a rotatable drum. The rotatable drum may comprise at least one permanent magnetic element positioned within the drum, and in certain embodiments, may comprise an array of permanent magnetic elements disposed inside a portion of a rotatable drum. In certain embodiments, the rotatable drum may comprise at least one magnet that is not permanent, that is, a magnet whose magnetic force can be turned on or turned off. As the drum rotates, magnetic material may attach, adhere, or affix to the drum surface. This may separate the nonmagnetic material which may be discharged separately from the magnetic particles. The drum may rotate in a tank continuously filled with a slurry, and the separation may take place typically without interruption. The at least one magnet or the array of magnets may be positioned within the rotatable drum in a fixed position. For example, as the drum rotates, the at least one magnet or the array of magnets does not rotate with the drum. The at least one magnet or the array of magnets may be configured to be fixed relative to a rotation of the rotatable drum.

The present disclosure may be used to recover magnetic material associated with wastewater treatment processes such as BioMag® and CoMag® processes but also may be used in the mining industry to remove particles of ferrous materials or one or more other magnetic materials.

The present disclosure provides systems and methods for distributing magnetic material directly onto the surface of the drum. It also provides systems and methods for separating nonmagnetic solids from magnetic material that may be economical, providing reductions in capital costs and operating costs relative to conventional separation systems and methods.

Referring to FIG. 1, a cross-sectional side view of an embodiment of a magnetic separator 100 with slide 150 is provided. Separator 100 may comprise rotatable drum 105. Interior of drum 105 may contain magnetic area 110 and nonmagnetic area 115.

Magnetic area 110 may comprise a magnet or an array of magnets. For the purposes of this specification, the term "magnet" is meant also to include an array of magnets. The magnet may comprise, for example, a permanent magnet. The magnet of magnetic area 110 is located in proximity to inner surface 120 of drum 105. The magnet is configured to exert a magnetic force on magnetic objects in the proximity of outer surface 125 of drum 105. The magnet inside drum 105 is kept at a fixed position while drum 105 rotates. The magnet is configured to be fixed relative to a rotation of drum 105, so as outer surface 125 of drum 105 rotates, new portions of surface 125 enter the magnetic field of the fixed magnet. The magnet may be positioned in greater than one half of inner surface 120 of rotatable drum 105, as shown in FIG. 1, wherein magnetic area 110 is in proximity to greater than one half of the area of inner surface 120. Furthermore, the magnet may be positioned at least partially in the upper half of rotatable drum 105, as shown in FIG. 1, wherein magnetic area 110 extends to the upper half of drum 105 on inlet 140 side. The magnet need not extend to the middle of the drum, but may be configured in a variety of ways such that its magnetic field extends over a portion of outer surface 125 of drum 105. Magnetic area 110 may extend under bottom portion of drum 105 so that magnetic material 155 in the slurry feed may continue to be exposed to a magnetic field of drum 105 up until the point that slurry 135 exits separator 100 through outlet 170. The other end of magnetic area 110 may extend far enough toward the top of drum 105 so that the magnetic material's momentum carries it over the top of drum 105, even after magnetic material 155 has passed out of the magnetic field.

The surface of the drum 105 is configured to rotate. It may rotate clockwise indicated by arrow 130, as in FIG. 1. Slurry 135 is fed into the area of drum 105 through inlet 140. Slurry 135 may comprise a mixture of liquids and solids. The solids may, for example, be solids that are part of a water or wastewater treatment. The solids may comprise a magnetic material and a nonmagnetic material. The magnetic material may be a ballast, for example. The magnetic material may be a ferrous material. The magnetic material may comprise magnetite. Magnetite is an iron oxide with the chemical formula $Fe_3O_4$. The nonmagnetic material may be solids that enter or are created in a treatment process. For example, the nonmagnetic material may be biological floc. The solids may form a conglomeration that includes magnetic and nonmagnetic material. Alternatively, the magnetic and nonmagnetic material may be separate.

In the embodiment shown in FIG. 1, slurry 135 travels through inlet chamber 185 over weir 145 through inlet 140 and onto slide 150 positioned in channel 180. Channel 180 is defined by outer wall 175 and the outer surface of the drum 125. When flow 135 passes over weir 145 of inlet chamber 185 it travels down the backside of the weir 145, where it then gets directed towards the drum 105. The velocity of slurry 135 after running down the backside of the weir 145 propels it off the inlet slide 150 onto drum's outer surface 125.

Inlet slide 150 may be curve-shaped or parabolic-shaped. Other shapes may also be used to direct the incoming magnetite slurry onto the drum surface, such as a v-shaped slide. Any shape is possible as long as the slurry flow is directed against surface 125 of magnetic drum 105. Slide 150 helps to put fluid 135 in contact with magnetic area 110 sooner and for a longer period of time. Another advantage of this configuration may be that it uses the fluid's velocity to further rinse nonmagnetic material 160 off of magnetic material 155 that has attached to drum 105 at a lower point.

By directing and "slinging" slurry mix 135 onto drum's surface 125, it increases the exposure time, allowing for more magnetite to be collected on drum 105 and better separation. By directing flow 135 onto drum's surface 125 it guarantees the majority of flow 135 has to come in direct contact with the effective magnetic surface area. Slide 150 ensures contact with the magnetic surface of drum 105 and increases the exposure time on drum surface 125 by forcing slurry 135 to come into contact with surface 125 sooner than with traditional systems. By bringing the entire incoming slurry 135 in direct contact with surface 125 of drum 105, inlet slide 150 reduces the likelihood that magnetic material would avoid contact with drum surface 125. This enhances magnetic material recovery efficiency by maximizing the magnetic field through which the magnetic material travels, and by reducing the distance the magnetic material must travel through the slurry to contact drum surface 125, where the recovery actually takes place.

Flow 135 also provides a rinsing action of the magnetic material, improving the separation of magnetic from nonmagnetic material in the slurry. Through the light "spraying action" on drum surface 125 due to slide 150, a rinsing process occurs, reducing the amount of nonmagnetic material adhering to drum surface 125. This improves the separation of magnetite from non-magnetic solids in the slurry by washing away the non-magnetite material that is enmeshed with the magnetite, further enhancing separation and recovery efficiency.

Magnetic material 155 adheres to outer surface 125 of drum 105 that is in proximity to magnet 110 and therefore travels in the direction of drum 105, for example, clockwise, as indicated by arrow 130. Magnetic material 155 may then be carried over the top portion of the drum where it may eventually come into contact with nonmagnetic area 115 of drum 105. Magnetic material 155 will then lose its magnetic attraction to drum surface 125 and travel toward magnetic material outlet 165. Magnetic material outlet 165 is in fluid communication with inlet 140 over a top portion of rotatable drum 105.

Nonmagnetic material 160 along with the liquid portion of the slurry follows the path of channel 180 to second outlet 170. Nonmagnetic material outlet 170 is in fluid communication with inlet 140 under a bottom portion of rotatable drum 105.

Figure 2:
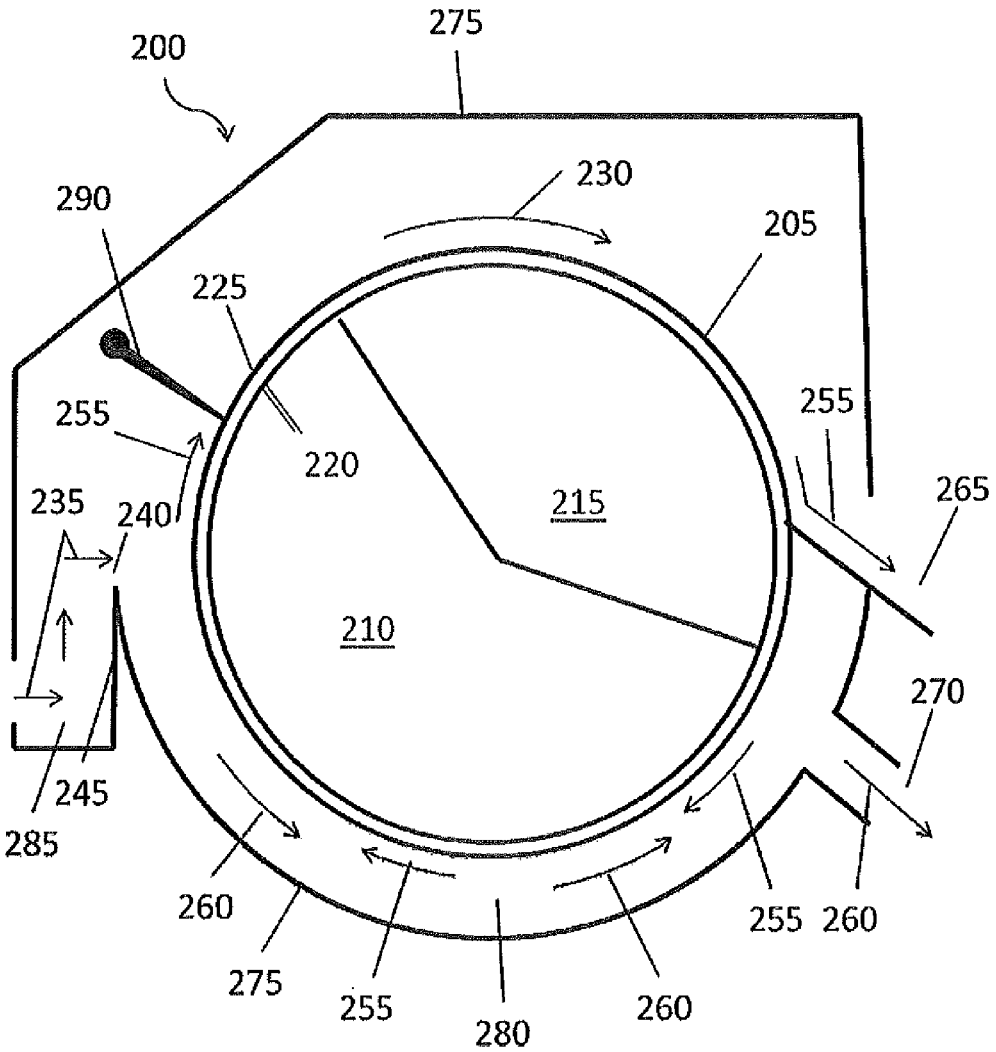
FIG. 2 presents a cross-sectional side view of a magnetic drum separator with scraper in accordance with one or more embodiments of the disclosure.

FIG. 2 presents a side view of an embodiment of wet drum magnetic separator 200 with scraper blade 290. The configuration of magnetic separator 200 is similar to that of FIG. 1. However, the embodiment of FIG. 2 comprises scraper blade 290 and does not include a slide. As drum 205 rotates clockwise indicated by arrow 230, material is carried upwards on outer surface 225 of drum 205. Magnetic material 255 that is attracted to drum surface 225 will overcome the resistance of scraper blade 290 and pass under it, while nonmagnetic material 260 that is attached to the magnetic material will be scraped off and redirected to channel 280 below. Magnetic material 255 will continue over a top portion of drum 205 where it will lose its attraction to drum surface 225 when it passes into nonmagnetic portion 215, and eventually the separated magnetic material 255 will pass out of separator 200 through outlet 265. Meanwhile nonmagnetic material 260 will travel through channel 280 and out of separator 200 through outlet 270.

The scraper blade 290 may comprise a flexible material such as rubber, a scraper blade backing plate and a scraper blade clamp. The scraper blade's flexible material can be made of either a synthetic or natural rubber. In one embodiment, the flexible material is ethylene propylene diene monomer (EPDM), a synthetic rubber material. Other materials such as acrylonitrile butadiene (BUNA-n), polytetrafluoroethylene (PTFE), silicone rubber and polychloroprene (Neoprene®) are possible to use. Still other embodiments may utilize a metal, such as steel or carbon steel. The material of the scraper blade may be magnetic. The disclosed embodiments are not limited by the type of material.

Scraper blade 290 is in direct contact with the drum face 225, but in other embodiments, it may not be in direct contact with the drum face. As drum 205 rotates, the nonmagnetic particles 260 are separated from the magnetic particles 255 by the scraper blade 290. Nonmagnetic particles 260, for example, bio-solids, fall back into the slurry. The magnetic material 255 remains adhered to drum 205, until it moves over the nonmagnetic area 215 and out outlet 265. In certain embodiments, scraper blade 290 may be positioned a predetermined distance away from the surface of drum 205.

Scraper blade 290 may be positioned near where slurry 235 first contacts the magnetic drum surface 225. Scraper blade 290 spans the length of the drum so that all surface 225 or circumference of drum 205 will be contacted by the scraper blade 290. More than one scraper blade 290 could be used to improve the separation efficiency.

Scraper blade 290 may be secured to an outer wall of the magnetic separator. Scraper blade 290, as shown in FIG. 2, is secured to an outer wall of magnetic separator running parallel to the plane of the cross-section.

The addition of a scraper blade 290 on the front face of the drum provides a very cost effective means of effectively enhancing this separation, ultimately allowing the influent solids loading rate on the drum to be reduced, thereby increasing the overall weight of magnetic material recovered and improving the overall efficiency of magnetic material recovery. This makes the drum more effective due to removing more nonmagnetic material creating a higher concentration in the nonmagnetic stream. This also makes, for example, a magnetite-ballasted biological treatment system more cost effective, both from capital and operation and maintenance standpoints. More efficient overall magnetic material recovery results in a reduced reliance on mechanical shearing devices (for example, shear mills), potentially resulting in significantly reduced capital expense on shear mills and the operation and maintenance costs to power and maintain the drums. Magnetic material 255 goes under the scraper blade 290 which then pushes the rest of nonmagnetic material 260 and water down the front of drum 205 and furthers the separation. The layer of magnetic material 260 on the drum's surface 225 depends on the load rate of the drum (can vary from very little to about 5/16 of an inch, or about 10 mm). Without scraper blade 290, flow 255 over drum 205 would vary between about 3 gallons per minute to about 5 gallons per minute (about 10 liters per minute to 20 liters per minute). With the addition of scraper blade 290, flow 255 may be reduced to about 1 gallon per minute to about 2 gallons per minute (about 3 liters per minute to about 8 liters per minute), an indication that less nonmagnetic material is being mixed into magnetic material outlet 265.

Figure 3:
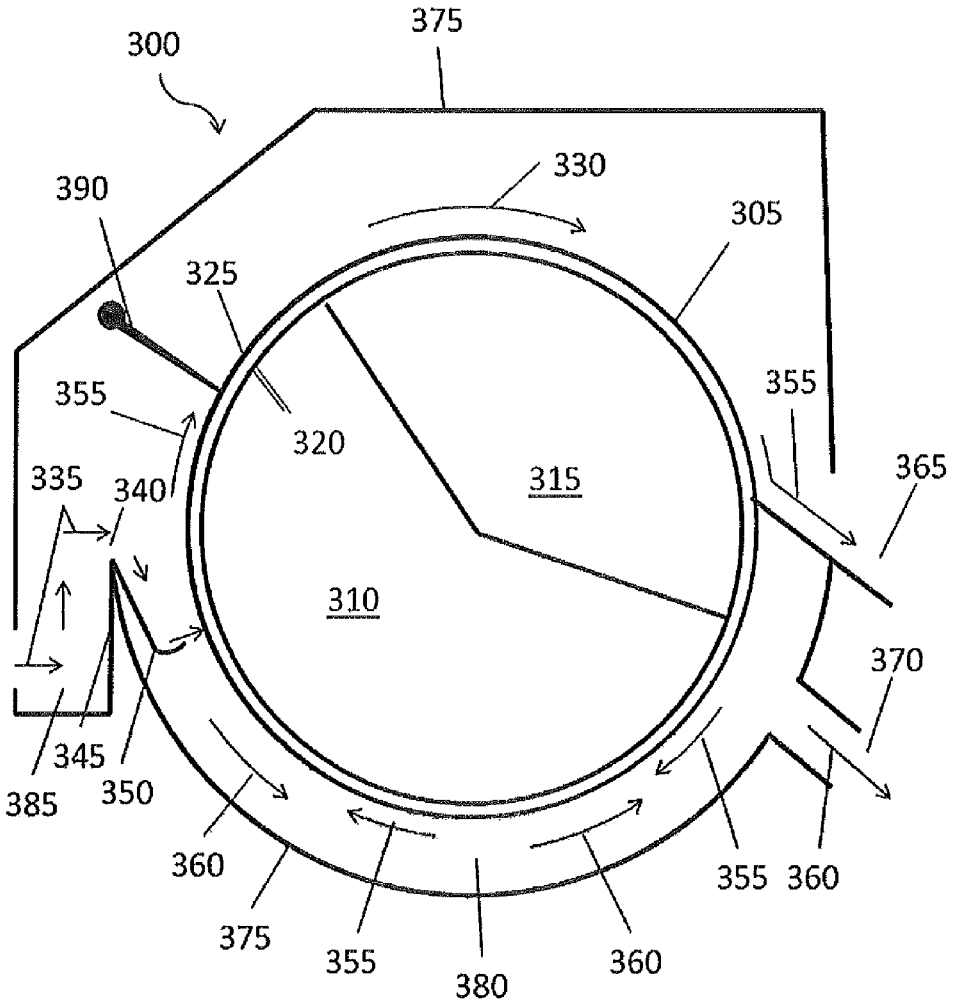
FIG. 3 presents a cross-sectional side view of a magnetic drum separator with slide and scraper in accordance with one or more embodiments of the disclosure.

FIG. 3 presents a side view of an embodiment of wet drum magnetic separator 300 with both slide 350 and scraper blade 390. In the embodiment pictured in FIG. 3, separator 300 is equipped with the advantages of a rinsing action and improved contact with the outer surface provided by the inclusion of slide 350. Separator 300 is also equipped with the advantages of scraping off nonmagnetic material from the magnetic material that is allowed to pass through scraper blade 390.

Figure 4:
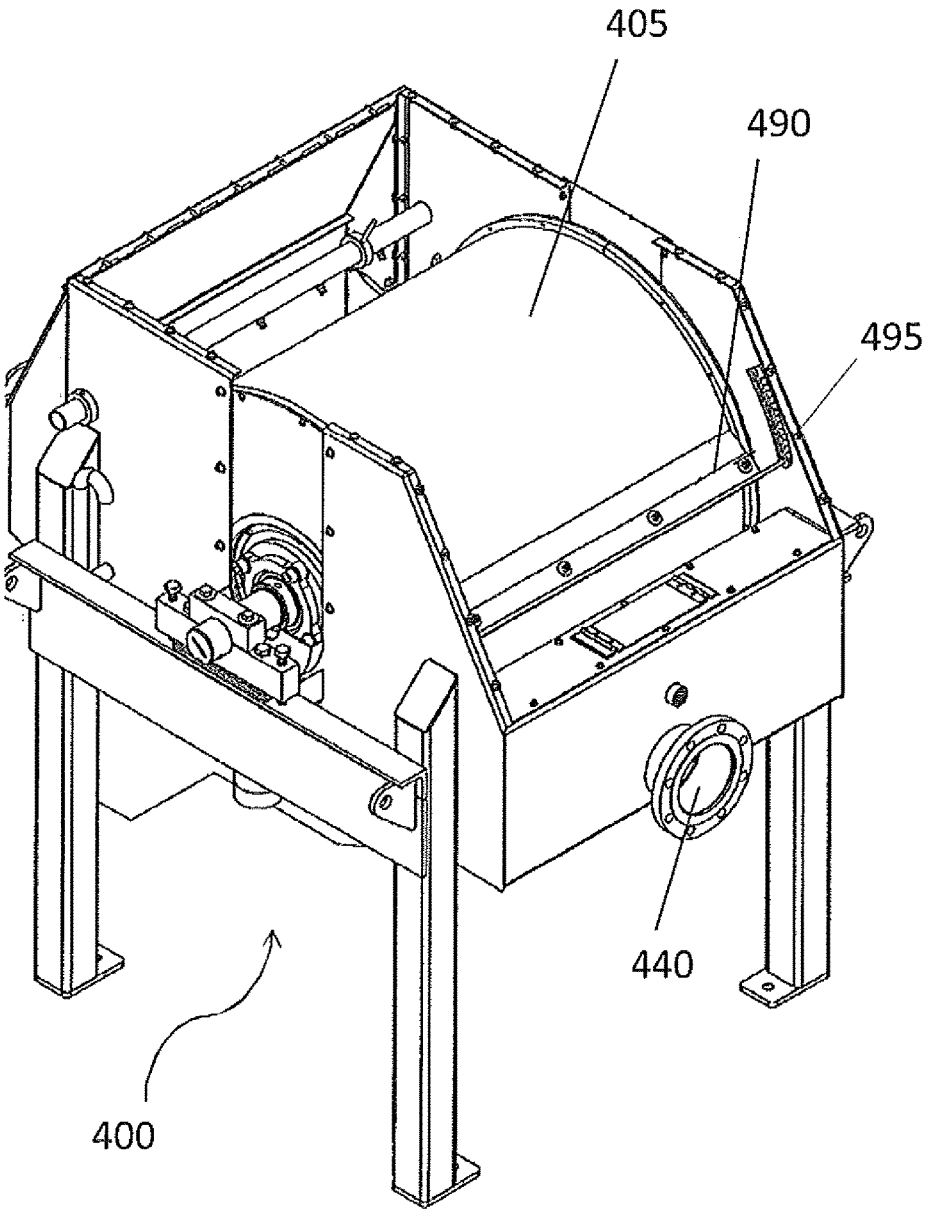
FIG. 4 presents a perspective view of a magnetic drum separator with scraper in accordance with one or more embodiments of the disclosure.

FIG. 4 presents a perspective view of wet drum magnetic separator 400. The slurry enters through inlet 440 and is directed to the surface of rotatable drum 405. Drum 405 rotates so that material adhering to the surface of drum 405, for example, through magnetic attraction, is brought into contact with scraper blade 490. Scraper blade 490 is secured to outer wall 495 of magnetic separator 400.

Figure 5:
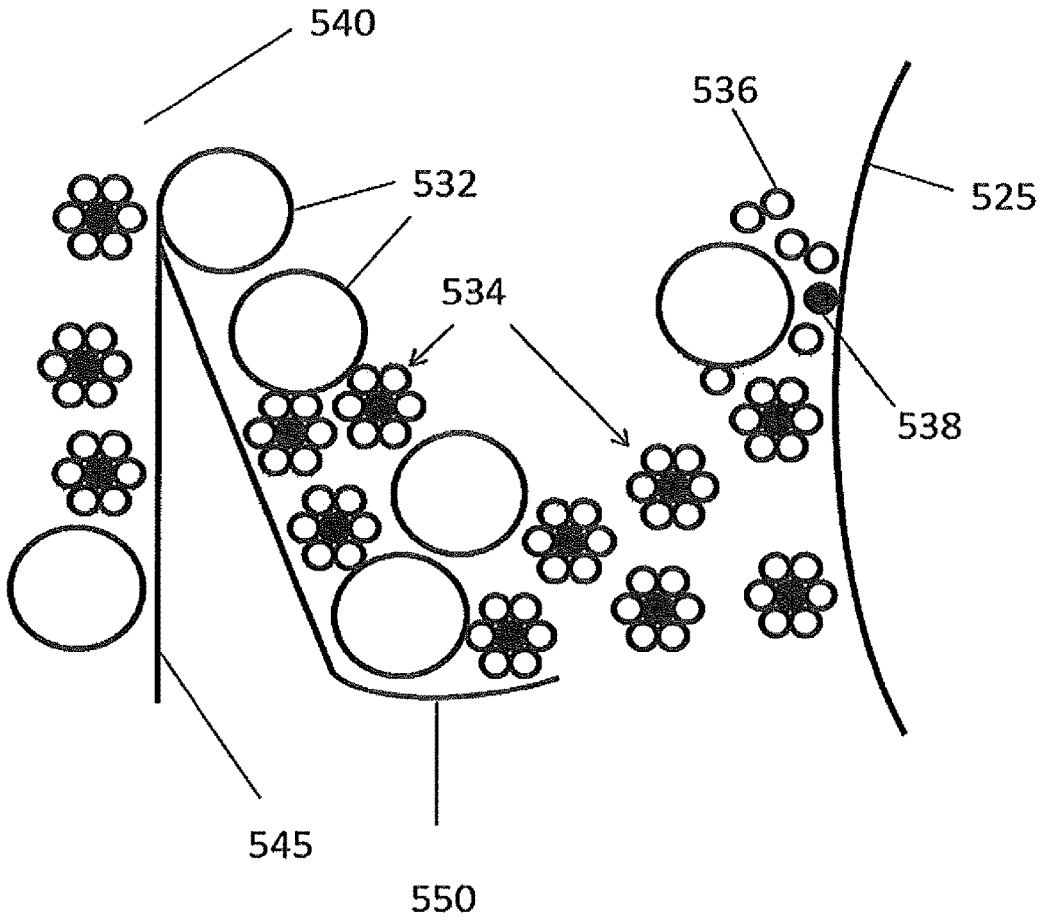
FIG. 5 presents a detailed side view of the slide in accordance with one or more embodiments of the disclosure.

FIG. 5 presents a detailed view of slide 550. Ballasted solids 534 comprising magnetic material 538 and nonmagnetic material 536 pass over the top of weir 545 and through drum area inlet 540. Slide 550 directs the flow towards drum surface 525 of the drum as shown. Slide 550 directs the slurry directly to drum surface525, thereby increasing the exposure of magnetic material 538 to drum surface 525, and making it more likely that magnetic material 538 will be carried away by the drum to a magnetic material outlet. Furthermore, the configuration of slide 550 produces a rinsing effect whereby the liquid portion of the slurry, for example, water droplet 532 washes off nonmagnetic material 536 from magnetic material 538 adhering to drum surface 525, as shown.

Figure 6:
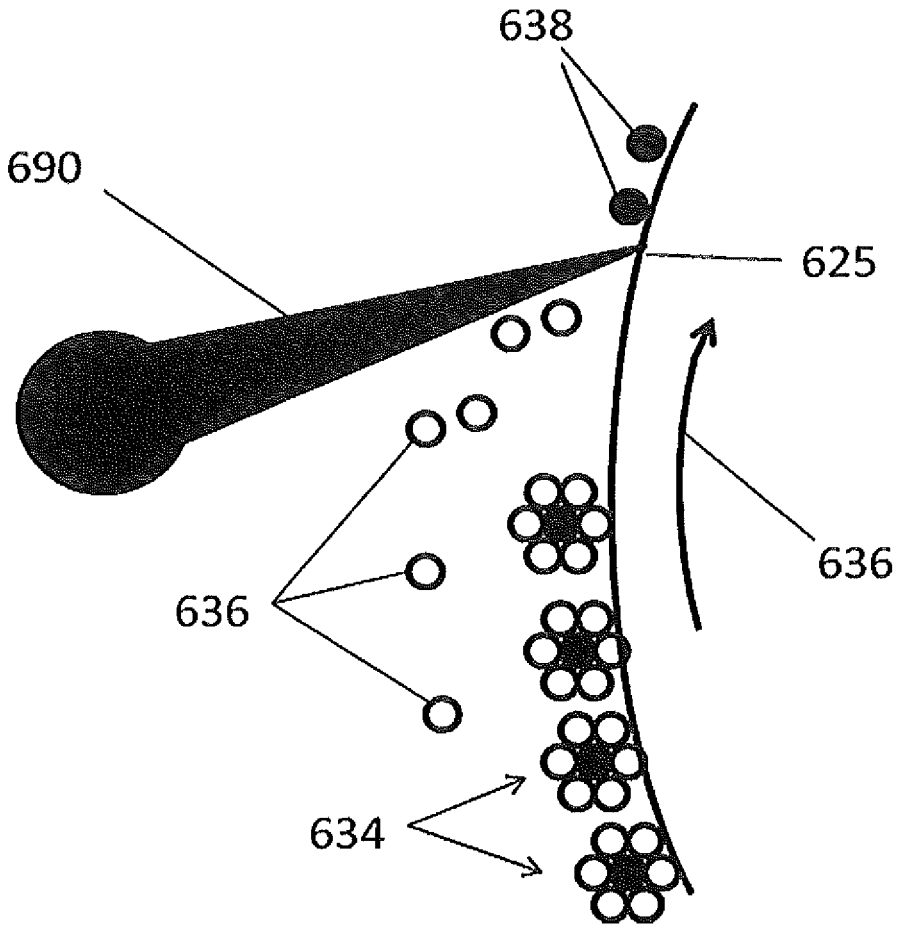
FIG. 6 presents a detailed side view of the scraper in accordance with one or more embodiments of the disclosure.

FIG. 6 presents a detailed view of scraper 690, in accordance with certain embodiments of the disclosure. Ballasted solids 634 adhere to the surface of the drum 625 due to, for example, a magnetic attraction. As drum 625 rotates as shown by arrow 636, ballasted solids 634 are brought into contact with scraper blade 690. Scraper blade 690 is configured to allow magnetic material 638 to pass by scraper blade 690 while nonmagnetic material 636 is scraped off and falls below, as shown.

In certain embodiments of the present disclosure, a method of retrofitting a magnetic separator may be provided. The magnetic separator may comprise a rotatable drum comprising an inner surface and an outer surface. The magnetic separator may also comprise a magnet positioned in the rotatable drum, and inlet connectable to a source of a slurry comprising a magnetic material and a nonmagnetic material and an outer wall. The separator may also comprise a channel defined by a portion of the outer surface of the rotatable drum and the outer wall. The method may comprise securing a slide to the outer wall. The slide may be positioned in the channel and in proximity to the inlet. The slide may be configured to direct the slurry upward. The method may also comprise securing a scraper blade to the outer wall.

A method of retrofitting a magnetic separator may also be provided wherein a scraper blade is secured to the outer wall of the separator, without securing a slide to the outer wall. While exemplary embodiments of the disclosure have been disclosed many modifications, additions, and deletions may be made therein without departing from the spirit and scope of the disclosure and its equivalents, as set forth in the following claims.

Those skilled in the art would readily appreciate that the various configurations described herein are meant to be exemplary and that actual configurations will depend upon the specific application for which the magnetic separator and methods of the present disclosure are used. Those skilled in the art will recognize, or be able to ascertain using no more than routine experimentation, many equivalents to the specific embodiments described herein. For example, those skilled in the art may recognize that the apparatus, and components thereof, according to the present disclosure may further comprise a network of systems or be a component of a wastewater treatment system. It is, therefore, to be understood that the foregoing embodiments are presented by way of example only and that, within the scope of the appended claims and equivalents thereto, the disclosed apparatus and methods may be practiced otherwise than as specifically described. The present apparatus and methods are directed to each individual feature or method described herein. In addition, any combination of two or more such features, apparatus or methods, if such features, apparatus or methods are not mutually inconsistent, is included within the scope of the present disclosure.

For example, the magnetic separator may be of any suitable geometry such that a rotatable drum may be positioned within. For example, the housing may be cylindrical, polygonal, square, or rectangular. With regard to the rotatable drum, any suitable geometry is acceptable so long as the drum may be positioned in the separator.

Further, it is to be appreciated various alterations, modifications, and improvements will readily occur to those skilled in the art. Such alterations, modifications, and improvements are intended to be part of this disclosure, and are intended to be within the spirit and scope of the disclosure. For example, an existing facility may be modified to utilize or incorporate any one or more aspects of the disclosure. Thus, in some cases, the apparatus and methods may involve connecting or configuring an existing facility to comprise a magnetic separator. Accordingly, the foregoing description and drawings are by way of example only. Further, the depictions in the drawings do not limit the disclosures to the particularly illustrated representations.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A magnetic separator, comprising:

a rotatable drum comprising an inner surface and an outer surface;

a magnet positioned in the rotatable drum to define a magnetic area and a nonmagnetic area associated with the separator;

an inlet connectable to a source of a slurry comprising a magnetic material and a nonmagnetic material;

an outer wall surrounding the rotatable drum;

a circumferential channel defined between the outer surface of the rotatable drum and the outer wall, positioned to define a top portion and a bottom portion;

a weir associated with the inlet;

a single v-shaped slide positioned in the circumferential channel in proximity to the inlet, having a proximal end facing the inlet and a distal end facing the rotatable drum, the slide configured to direct the slurry to the outer surface of the rotatable drum, the slide being associated with the weir and configured to increase slurry velocity, wherein, in operation, slurry travels through the inlet, over the weir, and onto the slide such that a velocity of the slurry subsequent to running down the weir propels the slurry off the slide and onto the outer surface of the rotatable drum;

a magnetic material outlet in fluid communication with the inlet through the top portion of the circumferential channel; and a nonmagnetic material outlet in fluid communication with the inlet through the bottom portion of the circumferential channel, the circumferential channel comprising a first fluid flow path in a first direction extending between the inlet and the magnetic material outlet and a second fluid flow path in a second direction opposite the first direction extending between the inlet and the nonmagnetic material outlet, the magnet being configured to be fixed relative to a rotation of the outer surface of the rotatable drum and positioned to extend the magnetic area into the top portion of the circumferential channel such that the magnetic area is configured to direct the magnetic material against gravity in the first direction and the nonmagnetic material with gravity in the second direction and the magnetic area is capable of carrying the magnetic material against gravity through the top portion of the circumferential channel.

2. The magnetic separator of claim 1, further comprising a scraper blade secured to the outer wall of the separator and configured to allow magnetic material to pass through the circumferential channel in the first direction while preventing nonmagnetic material from passing through the circumferential channel in the first direction.

3. The magnetic separator of claim 1, wherein the magnet is positioned at a predetermined portion of the inner surface of the rotatable drum.

4. The magnetic separator of claim 1, wherein the magnet is positioned in greater than half of the inner surface of the rotatable drum.

5. The magnetic separator of claim 1, wherein the slide is further configured to: assist in directing the slurry against the outer surface of the rotatable drum, assist in putting the slurry in contact with the magnetic area associated with the separator, facilitate rinsing of the magnetic material, or increase exposure time of the slurry on the outer surface of the rotatable drum.

6. A magnetic separator, comprising:

a rotatable drum comprising an inner surface and an outer surface;

a magnet positioned in the rotatable drum to define a magnetic area and a nonmagnetic area associated with the separator;

an inlet connectable to a source of a slurry comprising a magnetic material and a nonmagnetic material;

an outer wall surrounding the rotatable drum;

a circumferential channel defined between the outer surface of the rotatable drum and the outer wall, positioned to define a top portion and a bottom portion;

a weir associated with the inlet;

a single v-shaped slide positioned in the circumferential channel in proximity to the inlet, having a proximal end facing the inlet and a distal end facing the rotatable drum, the slide configured to direct the slurry to the outer surface of the rotatable drum, the slide being associated with the weir and configured to increase slurry velocity, wherein, in operation, slurry travels through the inlet, over the weir, and onto the slide such that a velocity of the slurry subsequent to running down the weir propels the slurry off the slide and onto the outer surface of the rotatable drum;

a magnetic material outlet in fluid communication with the inlet through the top portion of the circumferential channel; and a nonmagnetic material outlet in fluid communication with the inlet through the bottom portion of the circumferential channel, the magnet being configured to be fixed relative to a rotation of the outer surface of the rotatable drum and positioned to extend the magnetic area into the top portion of the circumferential channel.

7. The magnetic separator of claim 6, further comprising a scraper blade secured to the outer wall of the separator and configured to allow magnetic material to pass through the circumferential channel in a first direction while preventing nonmagnetic material from passing through the circumferential channel in the first direction.

8. The magnetic separator of claim 1, wherein the source of the slurry is associated with a wastewater treatment process.

9. The magnetic separator of claim 8, wherein the magnetic material comprises a ballast.

10. The magnetic separator of claim 9, wherein the ballast comprises magnetite.

* * * * *